US008421561B2

(12) United States Patent
Shinoura

(10) Patent No.: US 8,421,561 B2
(45) Date of Patent: Apr. 16, 2013

(54) HIGH FREQUENCY RELAY AND ITS CONNECTION STRUCTURE

(75) Inventor: Tatsuo Shinoura, Kyoto (JP)

(73) Assignee: OMRON Corporation, Kyoto (JP)

( * ) Notice: Subject to any disclaimer, the term of this patent is extended or adjusted under 35 U.S.C. 154(b) by 378 days.

(21) Appl. No.: 12/515,962

(22) PCT Filed: Dec. 4, 2007

(86) PCT No.: PCT/JP2007/073398

§ 371 (c)(1),
(2), (4) Date: May 22, 2009

(87) PCT Pub. No.: WO2008/069202

PCT Pub. Date: Jun. 12, 2008

(65) Prior Publication Data

US 2010/0052830 A1 Mar. 4, 2010

(30) Foreign Application Priority Data

Dec. 7, 2006 (JP) ..... 2006-330419

(51) Int. Cl.
*H01H 53/00* (2006.01)

(52) U.S. Cl.
USPC ..... 335/4; 335/5; 335/78; 335/132

(58) Field of Classification Search ..... 335/4–5, 335/78–86, 124, 128–132, 202, 274; 439/92, 439/607.01–607.59, 620.01
See application file for complete search history.

(56) References Cited

U.S. PATENT DOCUMENTS 4,766,401 A * 8/1988 Kjosness et al. ..... 333/12
5,815,057 A * 9/1998 Hoffman et al. ..... 335/4
5,952,902 A * 9/1999 Kich et al. ..... 335/4
5,994,986 A * 11/1999 Takahashi ..... 335/78
6,211,756 B1 * 4/2001 Sun et al. ..... 335/4
6,340,923 B1 * 1/2002 Yamanaka et al. ..... 335/4
6,781,489 B2 * 8/2004 Shima et al. ..... 335/78
7,119,943 B2 10/2006 Nelson et al.
2002/0121950 A1 * 9/2002 Kadoya et al. ..... 335/78
2002/0196111 A1 * 12/2002 Shinoura et al. ..... 335/78
2003/0148662 A1 * 8/2003 Shinoura et al. ..... 439/607
2006/0244555 A1 * 11/2006 Janot et al. ..... 335/78
2009/0102583 A1 * 4/2009 Nakamura et al. ..... 335/5

FOREIGN PATENT DOCUMENTS

JP 2-197041 A 8/1990
JP 5-199022 A 8/1993
JP 2006-515953 A 6/2006

OTHER PUBLICATIONS

International Search Report w/translation from PCT/JP2007/073398 dated Mar. 4, 2008 (3 pages).
Suzuki, Shigeo; "Easy-to-Understand Basic High Frequency Technology"; Nikkan Kogyo Shimbun Ltd., Sep. 30, 2003 (6 pages).
Patent Abstracts of Japan; Publication No. 02-197041 dated Aug. 3, 1990; Matsushita Electric Works Ltd. (1 page).
Extended European Search Report for Application No. 07850046.9, mailed on Jun. 8, 2012 (9 pages).

* cited by examiner

*Primary Examiner* — Mohamad Musleh
(74) *Attorney, Agent, or Firm* — Osha Liang LLP

(57) ABSTRACT

A high frequency relay has at least two drive terminal units arranged at an outer peripheral brim portion of at least two regions of three regions divided from a plane region of a base with a signal line. The base may be a plane triangle, plane square, plane hexagon, or a plane circle.

4 Claims, 13 Drawing Sheets

(A)

(B)

(A)

(B)

(A)

(B)

(A)

(B)

(A)

(B)

(A)

(B)

(A)

(B)

(A)

(B)

HIGH FREQUENCY RELAY AND ITS CONNECTION STRUCTURE

TECHNICAL FIELD

The present invention relates to high frequency relays, and in particular, to a high frequency relay to be mounted on a printed circuit board arranged with a high frequency circuit, and its connection structure.

BACKGROUND ART

Conventionally, a high frequency circuit arranged on a printed circuit board is provided with a signal line and mounted with a high frequency relay on the front surface of the printed circuit board, and formed with a ground pattern to realize a micro-strip line structure with respect to the signal line on the back surface of the printed circuit board to assure predetermined high frequency characteristics. A drive power supply line for controlling the high frequency relay is also provided on the printed circuit board. In such a printed circuit board, the design needs to be made such that the ground pattern is not divided by the signal line or the power supply line by the crossing of the signal lines with each other at the front and back surfaces, or the crossing of the signal line and the power supply line to transmit a high frequency signal without lowering the high frequency characteristics, as apparent from Non-Patent Document 1.

Non-Patent Document 1: Shigeo, Suzuki "Easy-to-Understand Basic high frequency technology", Issued from Nikkan Kogyo Shimbun Ltd.

DISCLOSURE OF THE INVENTION

Problems to be Solved by the Invention

However, when mounting and connecting the high frequency relay, in particular, a plurality of high frequency relays to the same printed circuit board, it is not easy to design the wiring pattern such that the ground pattern is not divided, and it is difficult to assure the desired high frequency characteristics.

In view of the above problems, an object of the present invention is to provide a high frequency relay capable of ensuring predetermined high frequency characteristics even when mounted on the printed circuit board and a connection structure of the high frequency relay.

Means for Solving the Problem

In order to achieve the above object, a high frequency relay according to the present invention has a configuration in which at least two drive terminal units are arranged at an outer peripheral brim portion of at least two regions of three regions divided from a plane region of a base with a signal line.

Effect of the Invention

According to the high frequency relay of the present invention, the drive terminal unit is appropriately selected, as needed, to arbitrarily select the pull-out position of the signal line and the power supply line, and thus a high frequency relay of high frequency characteristics without crossing of the signal lines or the signal line and the power supply line is obtained.

Another high frequency relay according to the present invention may have a plane triangle base.

According to the present embodiment, a high frequency relay of high space efficiency is obtained.

According to the embodiment of the present invention, a signal common terminal unit, a first signal terminal unit and a second signal terminal unit are arranged at each corner of a plane triangular base, and are alternately connectable; the drive terminal units on one side of the drive terminal units arranged in pairs at the outer peripheral brim portion of each side of the plane triangular base are mutually conductive and are connected to one end of an electromagnetic unit; and the remaining drive terminal units on the other side are mutually conductive and are connected to the other end of the electromagnetic unit.

In addition to the above effects, according to the present embodiment, since the signal terminal unit is arranged at each corner, the position of the signal terminal unit is easily found, and the connection work is facilitated and rapidly performed. Furthermore, the degree of freedom in connection is high, designing is facilitated, and the connection workability is high since the drive terminal unit is arranged in pairs at the outer peripheral brim portion of each side.

As a connection structure of a high frequency relay according to the present invention, the high frequency relay is arranged in a pyramid shape; first and second signal terminal units arranged at corners of a bottom of a high frequency relay positioned on an upper side are connected to a signal common terminal unit of a pair of high frequency relays positioned on the lower side; drive terminal units on one side of a pair of drive terminal units arranged between the first and second signal terminals units are connected to the drive terminal units on one side of the pair of high frequency relays positioned on the lower side; and the remaining drive terminal units on the other side are connected to the remaining drive terminals units on the other side of the pair of high frequency relays positioned on the lower side.

According to the present invention, the interconnection of the drive terminal units can be carried out within a space surrounded by the high frequency relays, and thus the space efficiency is high. Furthermore, as the power supply line can be pulled from the drive terminal unit of each side of the high frequency relay, the power supply line do not cross the signal line connecting the signal terminal units and lowering of high frequency characteristics can be prevented.

The high frequency relay according to the present invention may have a plane square base.

According to the present invention, a high frequency relay having high space efficiency is obtained.

The high frequency relay of the present invention may be configured such that a signal common terminal unit 20 arranged at one brim portion 15 of opposing brim portions 15, 16 on both sides of a plane square base and a pair of first and second signal terminal units 23, 24 arranged at the remaining other brim portion 16 are alternately connectable; a first drive terminal unit 21 of a pair of first and second drive terminal units 21, 22 arranged on one of the brim portions divided by the signal common terminal unit 20 of the brim portion 15 is mutually conducted to a fourth drive terminal unit 26 of a pair of third and fourth drive terminal units 25, 26 arranged between the first and second signal terminal units 23, 24 and connected to one end of an electromagnetic unit 70; and the second drive terminal unit 22 is mutually conducted to the third drive terminal unit 25 and connected to the other end of the electromagnetic unit 70.

In addition to the above effects, according to the present invention, a high frequency relay having satisfactory high frequency characteristics without crossing of the signal lines or the signal line and the power supply line is obtained.

In a connection structure of a high frequency relay of the present invention, the pair of high frequency relays 10, 17 described above are arranged to face brim portions 16, 16 arranged with first and second signal terminal units 23, 24 with respect to each other; first and second terminal units 23, 24 of the high frequency relay 10 are connected to second and first signal terminal units 24, 23 of the opposing high frequency relay 17; and third and fourth drive terminal units 25, 26 of the high frequency relay 10 are connected to fourth and third drive terminal units 26, 25 of the opposing high frequency relay 17.

According to the present invention, the power line connected to the drive terminal unit and the signal line connected to the signal terminal unit are connected so as not to cross on the printed circuit board, and thus a connection structure of a high frequency relay having satisfactory high frequency characteristics is obtained.

In another connection structure of a high frequency relay of the present invention, the pair of high frequency relays 10, 17 described above are arranged to face brim portions 16, 16 arranged with first and second signal terminal units 23, 24 with respect to each other; first and second signal terminal units 23, 24 of the high frequency relay 10 are connected to second and first signal terminal units 24, 23 of the opposing high frequency relay 17; and third and fourth drive terminal units 25, 26 of the high frequency relay 10 are connected so as to cross third and fourth drive terminal units 25, 26 of the opposing high frequency relay 17.

According to the present invention, the power line connected to the drive terminal unit and the signal line connected to the signal terminal unit are connected so as not to cross, and thus a connection structure of a high frequency relay having satisfactory high frequency characteristics is obtained.

In still another connection structure of a high frequency relay of the present invention, the pair of high frequency relays 10, 17 described above are arranged so that a brim portion 15 arranged with a signal common terminal unit 20 of the high frequency relay 10 and a brim portion 16 arranged with first and second signal terminal units 23, 24 of the high frequency relay 17 are parallel; the signal common terminal unit 20 of the high frequency relay 10 is connected to the first signal terminal unit 23 of the opposing high frequency relay 17, and first and second drive terminal units 21, 22 of the high frequency relay 10 and drive terminal units 21, 22 of the high frequency relay 17 are connected to an external power supply arranged on a same direction side; and first and second signal terminal units 23, 24 of the high frequency relay 10 and the second signal terminal unit 24 of the high frequency relay 17 are connected to an external device arranged on the opposite side of the external power supply.

According to the present invention, the power supply line connected to the drive terminal unit and the signal line connected to the signal terminal unit are connected so as not to cross, and thus a connection structure of a high frequency relay having satisfactory high frequency characteristics is obtained.

The high frequency relay of the present invention may be configured such that a signal common terminal unit 20 arranged at one brim portion 15 of opposing brim portions 15, 16 on both sides of a plane square base and a pair of first and second signal terminal units 23, 24 arranged at the remaining other brim portion 16 are alternately connectable; a first drive terminal unit 21 of the first and second drive terminal units 21, 22 arranged on both sides of the signal common terminal unit 20 of the brim portion 15 is mutually conducted to a fourth drive terminal unit 26 of a pair of third and fourth drive terminal units 25, 26 arranged between the first and second signal terminal units 23, 24, and connected to one end of an electromagnetic unit 70; and the second drive terminal unit 22 is mutually conducted to the third drive terminal unit 25 and connected to the other end of the electromagnetic unit 70.

According to the present invention, a high frequency relay having high space efficiency and satisfactory high frequency characteristics without crossing of the signal lines or the signal line and the power supply line is obtained.

In a connection structure of a high frequency relay of the present invention, the pair of high frequency relays 10, 17 described above are arranged to face brim portions 16, 16 arranged with first and second signal terminal units 23, 24 with respect to each other; first and second terminal units 23, 24 of the high frequency relay 10 are connected to second and first signal terminal units 24, 23 of the opposing high frequency relay 17; a third drive terminal unit 25 of the high frequency relay 10 is connected to the fourth drive terminal unit 26 of the opposing high frequency relay 17; and a first drive terminal unit 21 of the high frequency relay 10 and a second drive terminal unit 22 of the high frequency relay 17 are connected to same external power supply.

According to the present invention, the power supply line connected to the drive terminal unit and the signal line connected to the signal terminal unit are connected so as not to cross on the printed circuit board, and thus a connection structure of a high frequency relay having satisfactory high frequency characteristics is obtained.

In another connection structure of a high frequency relay of the present invention, the pair of high frequency relays 10, 17 described above are arranged to face brim portions 16, 16, arranged with first and second signal terminal units 23, 24, with respect to each other; first and second terminal units 23, 24 of the high frequency relay 10 are connected to second and first signal terminal units 24, 23 of the opposing high frequency relay 17; third and fourth drive terminal units 25, 26 of the high frequency relay 10 are connected to fourth and third drive terminal units 26, 25 of the opposing high frequency relay 17; and first drive terminal units 21, 22 of the high frequency relay 17 are connected to same external power supply.

According to the present invention, the power supply line connected to the drive terminal unit and the signal line connected to the signal terminal unit are connected so as not to cross on the printed circuit board, and thus a connection structure of a high frequency relay having satisfactory high frequency characteristics is obtained.

In still another connection structure of a high frequency relay of the present invention, the pair of high frequency relays 10, 17 described above are arranged to face brim portions 16, 16 arranged with first and second signal terminal units 23, 24 with respect to each other; first and second terminal units 23, 24 of the high frequency relay 10 are connected to second and first signal terminal units 24, 23 of the opposing high frequency relay 17; third and fourth terminals 25, 26 of the high frequency relay 10 are connected so as to respectively cross third and fourth drive terminal units 25, 26 of the opposing high frequency relay 17; and first drive terminal units 21, 22 of the high frequency relay 17 are connected to same external power supply.

According to the present invention, the power supply line connected to the drive terminal unit and the signal line connected to the signal terminal unit are connected so as not to cross, and thus a connection structure of a high frequency relay having satisfactory high frequency characteristics is obtained.

In yet another connection structure of a high frequency relay of the present invention, the pair of high frequency relays 10, 17 described above are arranged so that brim portions 16, 16, arranged with first and second signal terminal units 23, 24, are orthogonal; a second signal terminal unit 24 and a fourth drive terminal unit 26 of the high frequency relay 10 are connected to a first signal terminal unit 23 and a third drive terminal unit 25 of the high frequency relay 17; and a third drive terminal unit 25 of the high frequency relay 10 and a fourth drive terminal unit 26 of the high frequency relay 17 are connected to same external power supply.

According to the present invention, the power supply line connected to the drive terminal unit and the signal line connected to the signal terminal unit are connected so as not to cross, and thus a connection structure of a high frequency relay having satisfactory high frequency characteristics is obtained.

In yet another connection structure of a high frequency relay of the present invention, four high frequency relays 10, 17, 18, and 19 described above are arranged so that a brim portion 16, arranged with first and second signal terminal units 23, 24, form an annular shape; adjacent first and second signal terminal units arranged at both ends of the brim portion 16 are mutually connected; adjacent third and fourth drive terminal units 25, 26 of the adjacent three high frequency relays 10, 17, 18 are mutually connected; and a second drive terminal unit 22 of the high frequency relay 10 and a first drive terminal unit 21 of the high frequency relay 19 are connected to same external power supply.

According to the present invention, the power line for connecting the drive terminal units and the signal line for connecting the signal terminal units are connected do not cross, and thus a connection structure of a high frequency relay having satisfactory high frequency characteristics is obtained.

The high frequency relay according to the present invention may have a plane hexagonal base.

According to the present invention, a high frequency relay having high space efficiency can be obtained.

According to the embodiment of the present invention, a signal common terminal unit, a first signal terminal unit, and a second signal terminal unit are equally arranged at three corners of a plane regular hexagonal base and alternately connectable; a pair of drive terminal unit is arranged at an outer peripheral brim portion of each side of the plane regular hexagon; the drive terminal units on one side are mutually conductive and are connected to one end of an electromagnetic unit; and the remaining drive terminal units on the other side are mutually conductive and are connected to the other end of the electromagnetic unit.

According to the present invention, a high frequency relay having high space efficiency and satisfactory high frequency characteristics without crossing of the signal lines or the signal line and the power supply line is obtained.

In a connection structure of a high frequency relay of the present invention, each side of one high frequency relay described above is joined with each side of another high frequency relay to form a turtle shell pattern; adjacent drive terminal units are connected; and a signal terminal unit of one of the adjacent high frequency relays and a signal terminal unit of another high frequency relay are connected.

In addition to the above effects, according to the present invention, a connection structure of a high frequency relay having satisfactory high frequency characteristics is obtained since the power line connected to the drive terminal unit and the signal line connected to the signal terminal unit are connected so as not to cross.

The high frequency relay of the present invention may have a plane circular base.

According to the present invention, the high frequency relay is easy to arrange, and a high frequency relay having high degree of freedom in the connection work is obtained.

According to the embodiment of the present invention, a signal common terminal unit, a first signal terminal unit, and a second signal terminal unit are arranged at a boundary of an outer peripheral brim portion of each region obtained by dividing a plane region of a plane circular base into three by a signal line and are alternately connectable, a pair of drive terminal units is arranged at an outer peripheral brim portion of the region; the drive terminal units on one side are mutually conducted and connected to one end of an electromagnetic unit; and the remaining drive terminal units on the other side are mutually conductive and are connected to the other end of the electromagnetic unit.

In addition to the above effects, according to the present embodiment, a high frequency relay having satisfactory high frequency characteristics is obtained since the power supply line connected to the drive terminal unit and the signal line connected to the signal terminal unit are connected so as not to cross.

In a connection structure of a high frequency relay of the present invention, first and second signal terminal units of one high frequency relay described above are connected to signal common terminal units of a pair of high frequency relays positioned on a lower side; a drive terminal unit on one side of a pair of drive terminal units positioned between the first and second signal terminal units is connected to a drive terminal unit on one side of the pair of high frequency relays positioned on the lower side; and the remaining drive terminal units on the other sides are connected to the drive terminal units on the other side of the pair of high frequency relays positioned on the lower side.

According to the present invention, the power line connected to the drive terminal unit and the signal line connected to the signal terminal unit are connected so as not to cross on the printed circuit board, and thus a high frequency relay having satisfactory high frequency characteristics is obtained.

DESCRIPTION OF SYMBOLS

Figure 1:
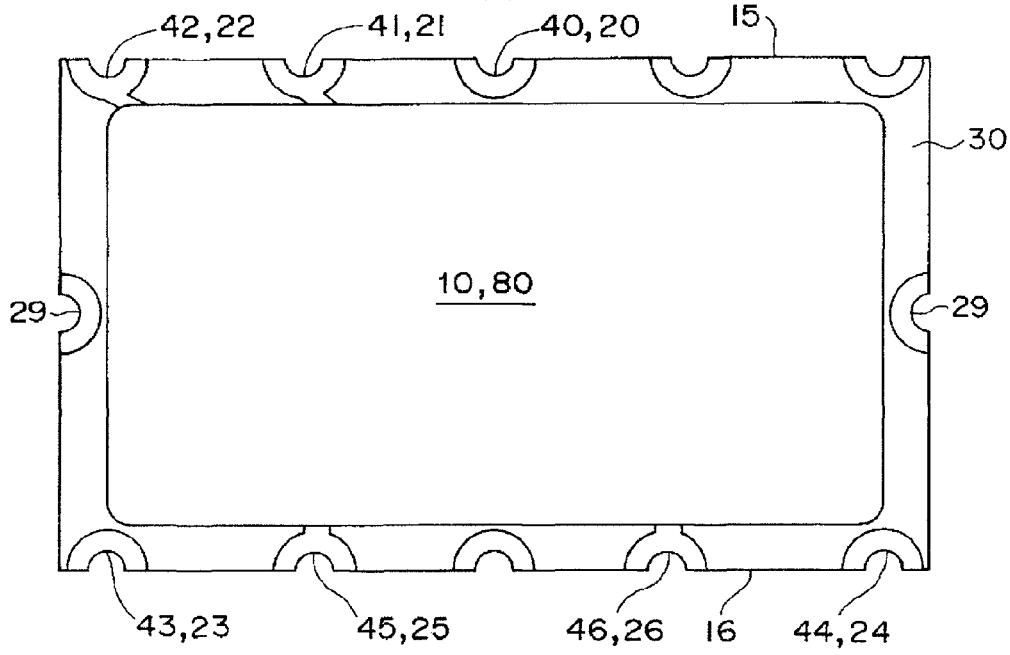
FIGS. 1A and 1B are a plan view and a cross-sectional view each showing a first embodiment of a high frequency relay according to the present invention.
Figure 1:
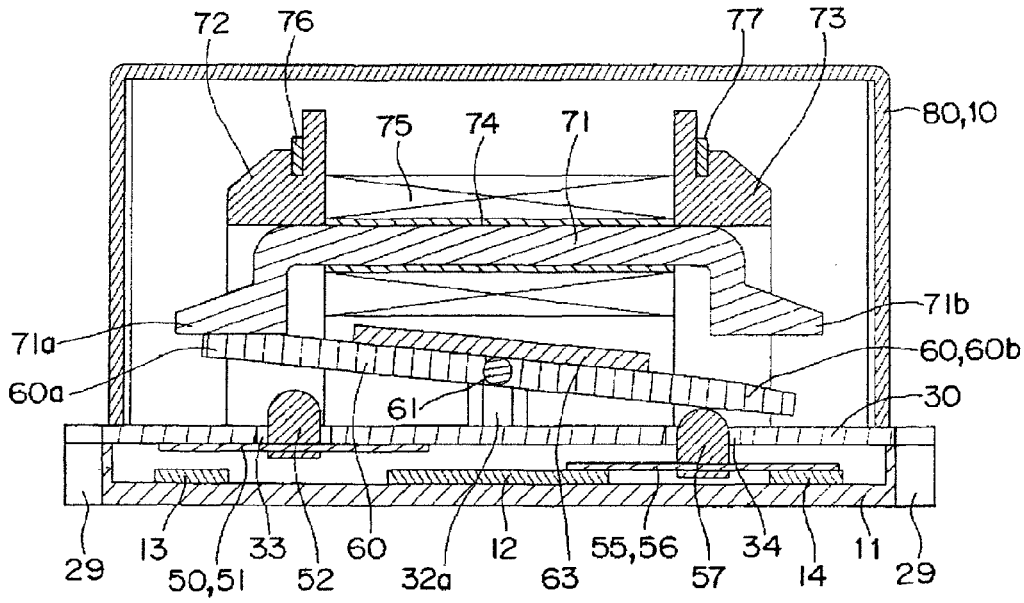

10, 17, 18, 19: High frequency relay
12: Common fixed contact
13, 14: Fixed contact
15, 16: Brim portion
20: Signal common terminal unit
21, 22: First and second drive terminal units
23, 24: First and second signal terminal units
25, 26: Third and fourth drive terminal units
29: Dummy terminal unit
101 to 112: High frequency relay
120 to 125: Brim portion
130 to 141: Drive terminal unit
150: Signal common terminal unit
151, 152: First and second signal terminal units

BEST MODE FOR CARRYING OUT THE INVENTION

An embodiment of the present invention will be described with reference to the accompanying drawings FIG. 1 to FIG. 13.

Figure 2:
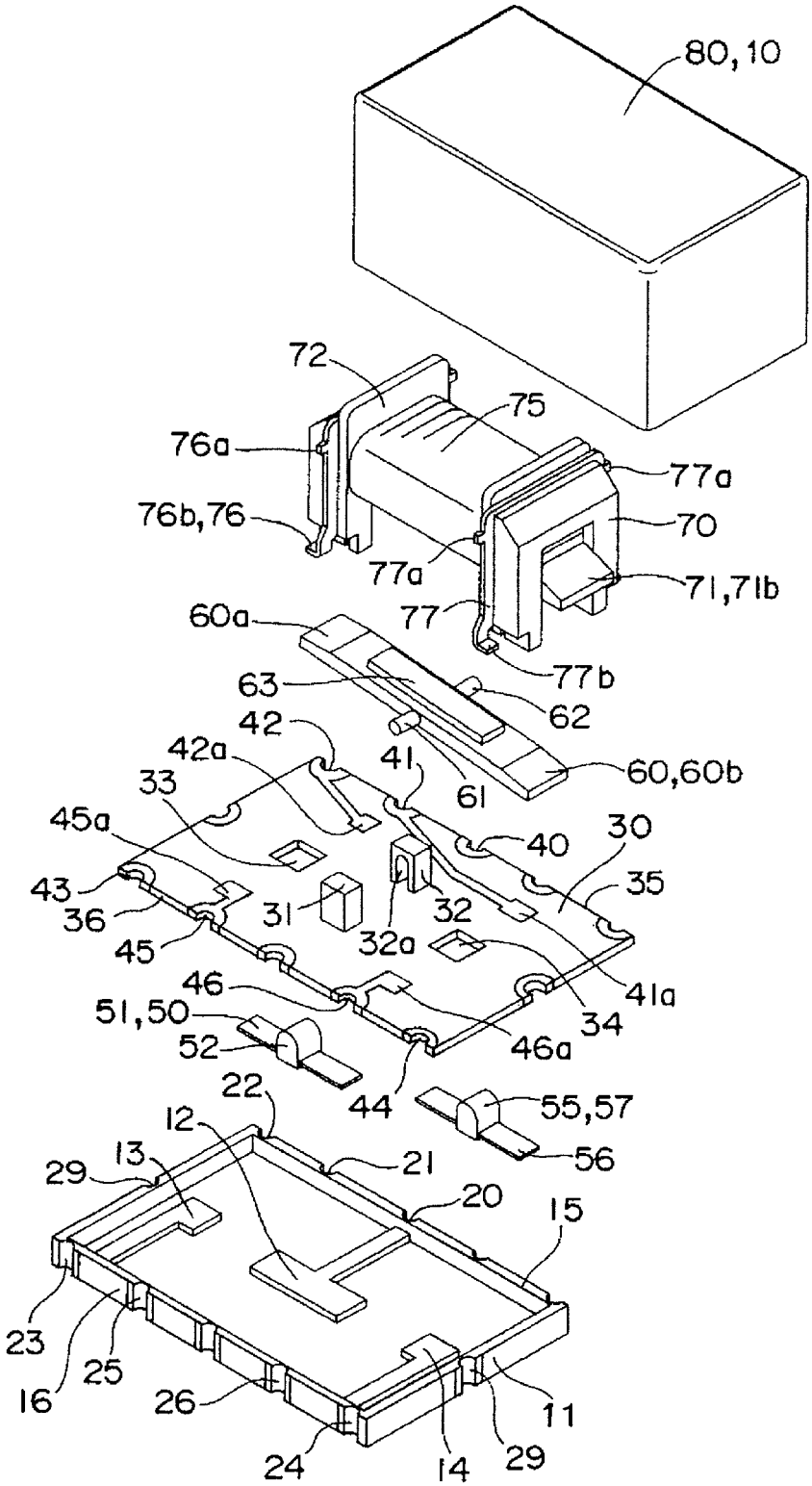
FIG. 2 is an exploded perspective view of the high frequency relay shown in FIG. 1.

As shown in FIG. 1 and FIG. 2, a first embodiment is a case applied to a self-holding high frequency relay 10. The self-holding high frequency relay 10 includes a base 11, a supporting wiring substrate 30, a pair of movable contact pieces 50, 55, a movable iron piece 60, an electromagnetic unit 70, and a case cover 80.

The base 11 is formed in a box-shape having shallow bottom, and has a signal common fixed contact 12 and a pair signal fixed contacts 13, 14 arranged on the same line at the bottom surface. The signal common fixed contact 12 is electrically connected to a signal common terminal unit 20 arranged at the middle of a brim portion 15 of the base 11. A pair of first and second drive terminal units 21, 22 are arranged on one side of the signal common terminal unit 20 of the brim portion 15. A first and second signal terminal units 23, 24 electrically connected to the signal fixed contacts 13, 14, respectively, are arranged at both ends of the brim portion 16 facing the brim portion 15. A pair of third and fourth drive terminal units 25, 26 is arranged between the first and second signal terminal units 23, 24 arranged at the brim portion 16.

A supporting wiring substrate 30 is a plate-shaped insulating body having a planar shape that can cover the opening brim portion of the base 11, where a pair of supporting projections 31, 32 is arranged at the middle on the upper surface, and a pair of operation holes 33, 34 is formed on a center line passing between the supporting projections 31, 32. Support grooves 31*a* (not shown), 32*a* are formed on the opposite faces of the supporting projections 31, 32. The supporting wiring substrate 30 also has opposing brim portions 35, 36. A signal relay common terminal unit 40 and first and second drive relay terminal units 41, 42 are arranged at positions corresponding to the terminal units 20, 21 arranged on the base 11 of the brim portion 35 on one side. Connection pads 41*a*, 42*a* that can be electrically connected to relay terminals 76, 77 of the electromagnetic unit 70, to be hereinafter described, extend from the drive relay terminal units 41, 42. Of the brim portion 36 on the other side of the supporting wiring substrate 30, first and second signal relay terminal units 43, 44 are arranged at both ends, and a pair of third and fourth drive relay terminal units 45, 46 are arranged between the signal relay terminals 43, 44. Connection pads 45*a*, 46*a* that can be electrically connected to the relay terminals 76, 77 of the electromagnetic unit 70, to be hereinafter described, extend from the third and fourth drive relay terminal units 45, 46

The movable contact pieces 50, 55 have operation units 52, 57 respectively outsert molded at the middle of contact pieces 51, 56 made of rectangular-shaped conductive material. The movable contact pieces 50, 55 have the operation units 52, 57 fitted to the operation holes 33, 34 of the supporting wiring substrate 30 from the lower side so as to be projected, and are biased to the upper side by way of a coil spring (not shown).

The movable iron piece 60 is made of band-shaped magnetic material, where supporting shafts 61, 62 are coaxially arranged in a projecting manner at the middle on both side surfaces, and a rectangular permanent magnet 63 is integrated at the middle of the upper surface. The supporting shafts 61, 62 are respectively fitted into support grooves 31*a* (not shown), 32*a* of the supporting projections 31, 32 arranged in a projecting manner on the supporting wiring substrate 30 so as to be turnably supported.

The electromagnetic unit 70 has magnetic pole portions 71*a*, 71*b* formed by press-working both ends of a substantially C-shaped iron core 71, and collar portions 72, 73 respectively assembled. A coil 75 is wound to a central part of the iron core 71 by way of an insulation tape 74. A lead line of the coil 75 is engaged and soldered to the relay projections 76*a*, 77*a* of gate-shaped relay terminals 76, 77 assembled to the collar portions 72, 73. Terminal portions 76*a*, 76*b* at both ends of the relay terminal 76 and terminal portions 77*a*, 77*b* at both ends of the relay terminal 77 are respectively positioned and soldered at the connection pads 42*a*, 45*a*, and 41*a*, 46*a* of the supporting wiring substrate 30.

As shown in FIG. 1A, the case cover 80 has a box-shape that can cover the supporting wiring substrate 30 while leaving out the peripheral brim portion thereof, and is fixed on the supporting wiring substrate 30 to shield the electromagnetic unit 70 and the like from the outside.

When assembling the high frequency relay 10 including the above-described components, the projections 52, 57 of the movable contact pieces 50, 55 are fitted to the operation holes 33, 34 of the supporting wiring substrate 30 and projected at the base 11 by way of the coil spring (not shown). The supporting wiring substrate 30 is fixed to the base 11. The supporting shafts 61, 62 of the movable iron piece 60 are then fitted to the support grooves 31*a* (not shown), 32*a* of the supporting projections 31, 32 to be turnably supported. Furthermore, the electromagnetic unit 70 is positioned, soldered, and fixed on the supporting wiring substrate 30. The assembly task is completed after positioning and fixing the case cover 80 to the supporting wiring substrate 30.

The operation of the high frequency relay 10 made up of components described above will be described.

As shown in FIG. 1B, in the case of no-excitation, one end 60*a* of the movable iron piece 60 is attracted to the magnetic pole portion 71*a* of the iron core 71, and the other end 60*b* pushes the operation unit 57 of the movable contact piece 55 against the spring force of the coil spring (not shown). Thus, both ends of the contact piece 56 of the movable contact piece 55 are respectively contacted to the signal common fixed contact 12 and the signal fixed contact 14. Both ends of the contact piece 51 of the movable contact piece 50 are respectively separated from the signal common fixed contact 12 and the signal fixed contact 13.

When voltage is applied to excite the coil 75 so that the magnetic pole portion 71*b* of the iron core 71 attracts the other end 60*b* of the movable iron piece 60, the movable iron piece 60 turns with the supporting shafts 61, 62 as the center. After one end 60*a* of the movable iron piece 60 separates from the magnetic pole portion 71*a* of the iron core 71, the other end 60*b* of the movable iron piece 60 attracts to the magnetic pole portion 71*b* of the iron core 71. Thus, the movable contact piece 55 is pushed up and raised by the spring force of the coil spring, and both ends of the contact piece 56 respectively separate from the signal common fixed contact 12 and the signal fixed contact 14 thereby opening the circuit. The movable contact piece 50 is pushed down, and both ends of the contact piece 51 respectively contact the signal common fixed contact 12 and the signal fixed contact 13 thereby closing the circuit. Such a state is held by the magnetic force of the permanent magnet 63 even if the application of voltage on the coil 75 is stopped.

When voltage is applied on the coil 75 in the direction opposite to the above, the magnetic pole portion 71*a* of the iron core 71 attracts the other end 60*a* of the movable iron piece 60, and the movable iron piece 60 turns in the opposite direction with the supporting shafts 61, 62 as the center. After one end 60*b* of the movable iron piece 60 separates from the magnetic pole portion 71*b* of the iron core 71, the other end 60*a* of the movable iron piece 60 attracts to the magnetic pole portion 71*a* of the iron core 71. Thus, the movable contact piece 50 is pushed up and raised by the spring force of the coil spring (not shown), and both ends of the contact piece 51 respectively separate from the signal common fixed contact 12 and the signal fixed contact 13. The movable contact piece 55 is pushed down, and both ends of the contact piece 56 respectively contact the signal common fixed contact 12 and the signal fixed contact 14. Such a state is held even if the application of voltage is stopped.

Figure 3:
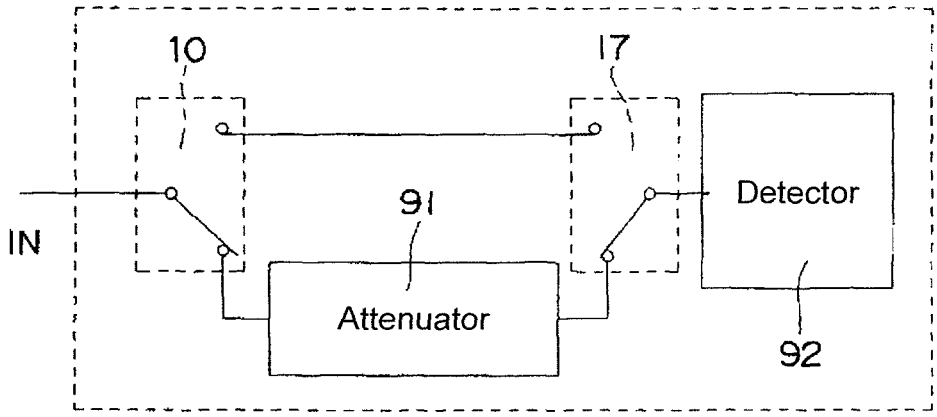
FIG. 3 is a circuit diagram applied with the high frequency relay shown in FIG. 1 and a plan view showing a connection structure.
Figure 3:
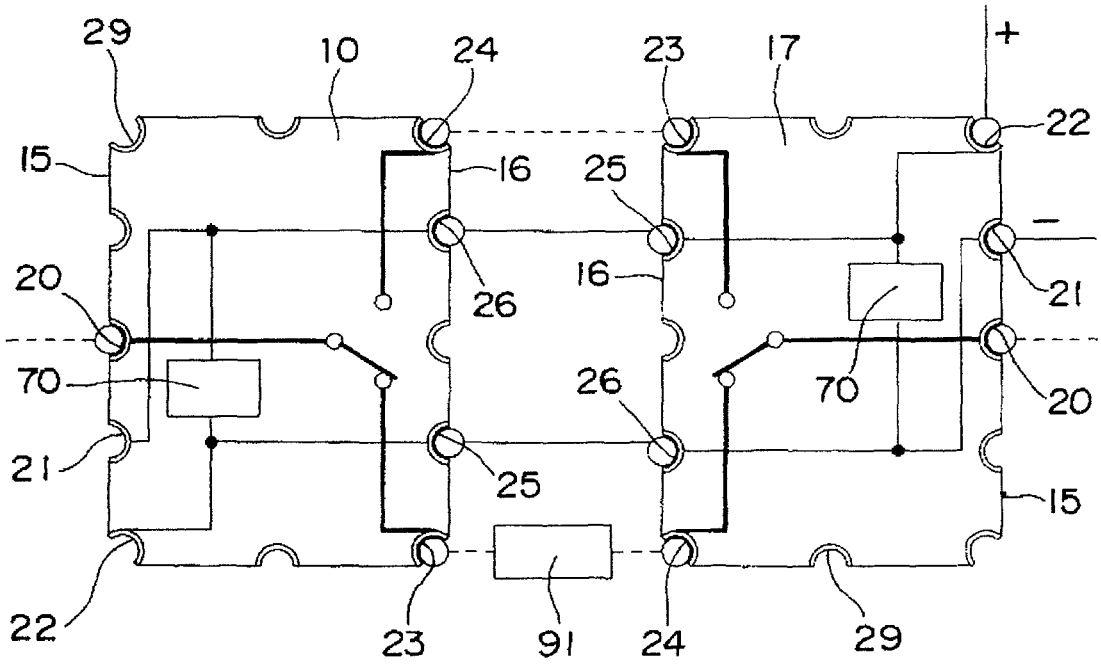

As a connection structure in which two high frequency relays 10, 17 having the same structure as the high frequency relay described above are combined, a case of arranging and connecting the brim portions 16, 16 of the two high frequency relays 10, 17 so as to face each other, as schematically shown in FIG. 3, is known. The connection structure according to the present embodiment will be described based on the high frequency relay in which a dummy terminal unit 29 that can be diverted to the signal terminal unit and the drive terminal unit is appropriately arranged at the outer peripheral brim portions of the high frequency relays 10, 17 for the sake of convenience of explanation.

In other words, the high frequency relay 10 has the first terminal unit 23 connected to the second signal terminal unit 24 of the opposing high frequency relay 17 by way of an attenuator 91. The high frequency relay 10 has the second signal terminal unit 24 connected to the first signal terminal unit 23 of the opposing high frequency relay 17. Furthermore, the third and forth drive terminal units 25, 26 of the high frequency relay 10 are respectively connected to the fourth and third drive terminal units 26, 25 of the opposing high frequency relay 17. The signal common terminal unit 20 of the high frequency relay 10 is connected to a signal input device (not shown). The signal common terminal unit 20 of the high frequency relay 17 is connected to a detector 92. Moreover, the first and second drive terminal units 21, 22 of the high frequency relay 17 are connected to an external power supply. The dummy terminal unit 29 that can be diverted to the signal terminal unit and the drive terminal unit is appropriately arranged, as previously described, on the outer peripheral brim portion of the high frequency relays 10, 17.

According to the present embodiment, the signal line and the power supply line between the high frequency relays 10, 17 do not cross, as shown in FIG. 3B. The pair of first and second drive terminal units 21, 22 of the high frequency relay 17 are arranged on one side of the signal common terminal unit 20, and the signal line and the power supply line on the mounted printed circuit board (not shown) do not cross, whereby a connection structure of the high frequency relay that can assure predetermined high frequency characteristics can be obtained.

Figure 4:
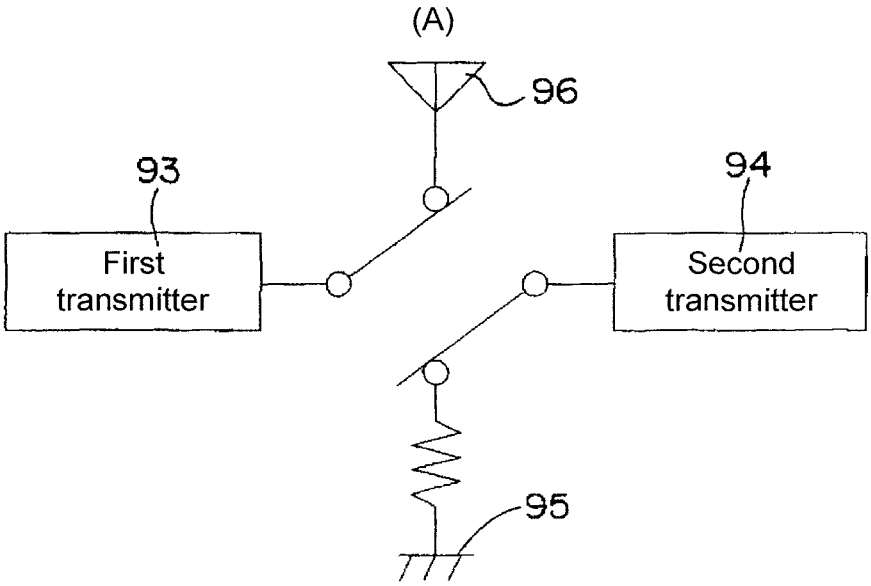
FIGS. 4A and 4B are a circuit diagram applied with a high frequency relay showing a second embodiment and a plan view showing a connection structure.
Figure 4:
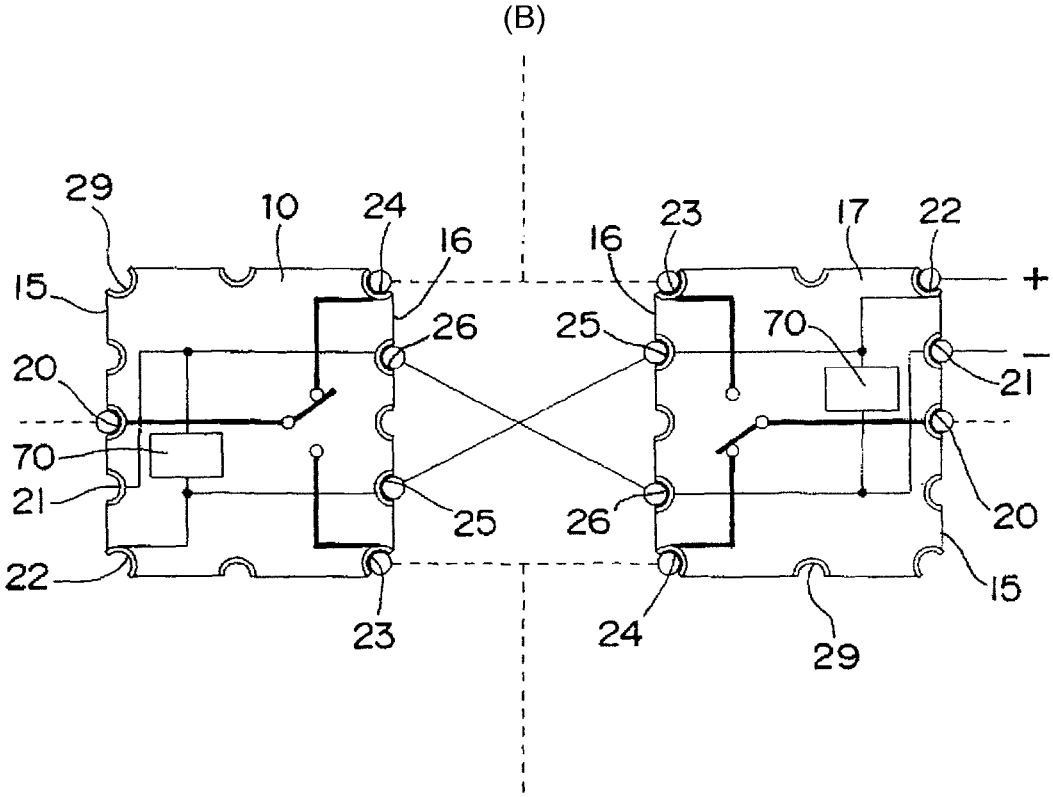

As shown in FIG. 4, a second embodiment is a case applied to a redundancy system switching application such as broadcast system infrastructure by connecting the pair of high frequency relays 10, 17, which are arranged such that the brim portions 16, 16 face each other, to two or first and second transmitters 93, 94.

In other words, the first signal terminal unit 23 of the high frequency relay 10 is connected to the second signal terminal unit 24 of the opposing high frequency relay 17, and also connected to a ground 95. The second signal terminal unit 24 of the high frequency relay 10 is connected to the first signal terminal unit 23 of the opposing high frequency relay 17, and also connected to an antenna 96. The signal common terminal unit 20 of the high frequency relay 10 is connected to the first transmitter 93, and the signal common terminal unit 20 of the high frequency relay 17 is connected to the second transmitter 94. The third and fourth drive terminal units 25, 26 of the high frequency relay 10 are connected to the third and fourth drive terminal units 25, 26 of the high frequency relay 17, respectively. The first and second drive terminal units 21, 22 of the high frequency relay 17 are respectively connected to the external power supply.

According to the present embodiment, the signal line and the power supply line between the high frequency relays 10, 17 do not cross. Furthermore, the pair of first and second drive terminal units 21, 22 of the high frequency relay 17 are arranged on one side of the signal common terminal unit 20, and print wired such that the power supply line does not cross the signal line, and thus a connection structure of a high frequency relay having excellent high frequency characteristics is obtained.

Figure 5:
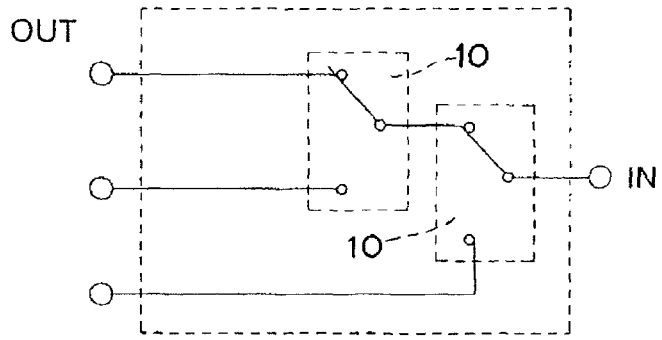
FIGS. 5A and 5B are a circuit diagram applied with a high frequency relay showing a third embodiment and a plan view showing a connection structure.
Figure 5:
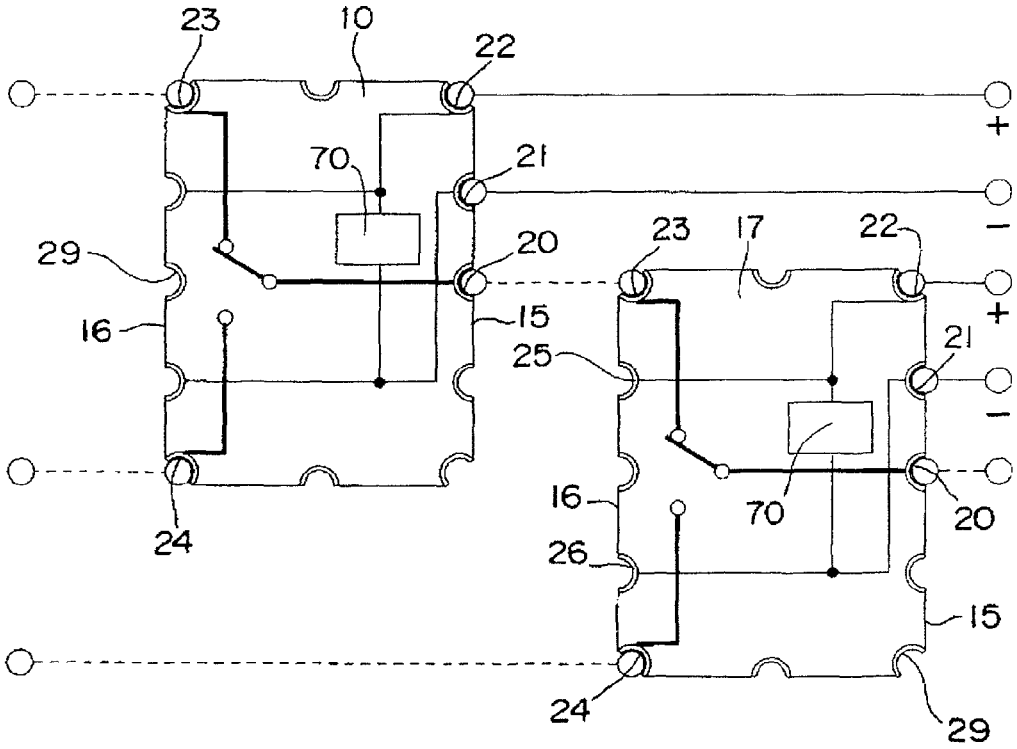

As shown in FIG. 5, a third embodiment is a case applied to a tournament connection such as SP3T by arranging the brim portions 16, 16 of the pair of high frequency relays 10, 17 in parallel so as to partially face each other.

In other words, the first and second signal terminal units 23, 24 of one high frequency relay 10 are connected to the signal output device (not shown), and the signal common terminal unit 20 is connected to the first signal terminal unit 23 of the high frequency relay 17. The first and second drive terminal units 21, 22 of the high frequency relay 10 are connected to the external power supply. The signal common terminal unit 20 of the other high frequency relay 17 is connected to the external input device, and the second signal terminal unit 24 is connected to the external output device. The high frequency relay 17 has the first and second drive terminal units 21, 22 connected to the external power supply.

According to the present embodiment, since all of the first and second drive terminal units 21, 22 are collected on one side, the print wiring can be performed such that the power supply line and the signal line do not cross, and a connection structure of the high frequency relay having excellent high frequency characteristics is obtained.

Figure 6:
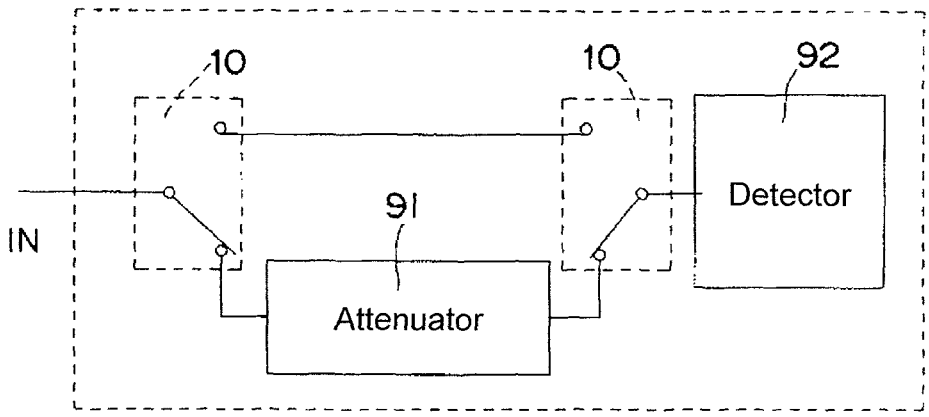
FIGS. 6A and 6B are a circuit diagram applied with a high frequency relay showing a fourth embodiment and a plan view showing a connection structure.
Figure 6:
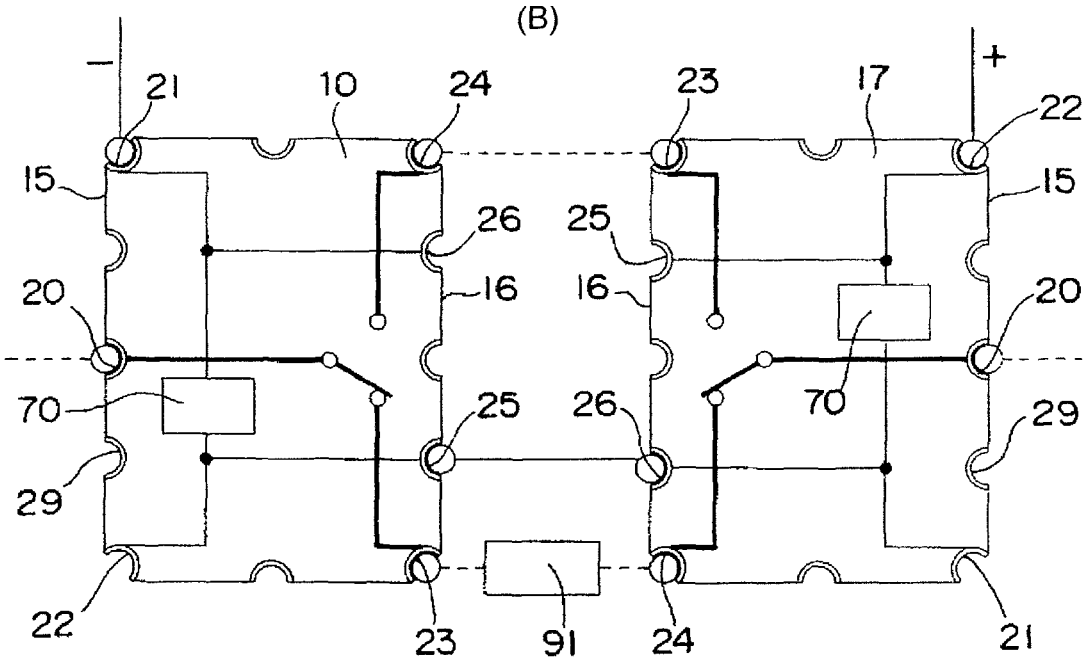

As shown in FIG. 6, a fourth embodiment is a case applied to switching of a filter attenuator used in measurement equipment. The high frequency relays 10, 17 according to the present embodiment are the same as the previously described high frequency relay other than that the first and second drive terminal units 21, 22 are arranged on both sides of the signal common terminal unit 20.

In other words, the two high frequency relays 10, 17 are arranged such that the brim portions 16, 16 face each other. The first signal terminal unit 23 of the high frequency relay 10 is connected to the second signal terminal unit 24 of the opposing high frequency relay 17 by way of the attenuator 91. The second signal terminal unit 24 of the high frequency relay 10 is connected to the first signal terminal unit 23 of the opposing high frequency relay 17. The third drive terminal unit 25 of the high frequency relay 10 is connected to the fourth drive terminal unit 26 of the opposing high frequency relay 17. The signal common terminal unit 20 of the high frequency relay 10 is connected to the signal input device (not shown), and the signal common terminal unit 20 of the high frequency relay 17 is connected to the detector 92. The first drive terminal unit 21 of the high frequency relay 10 and the second drive terminal unit 22 of the high frequency relay 17 are connected to the external power supply.

According to the present embodiment, as shown in FIG. 6B, the first drive terminal unit 21 of the high frequency relay 10 and the second drive terminal unit 22 of the high frequency relay 17 are pulled out in the same direction side, and connected to the external power supply. Thus, the signal line and the power supply line of the printed circuit board (not shown) to mount do not cross, and a connection structure of a high frequency relay that can ensure the desired high frequency characteristics is obtained.

Figure 7:
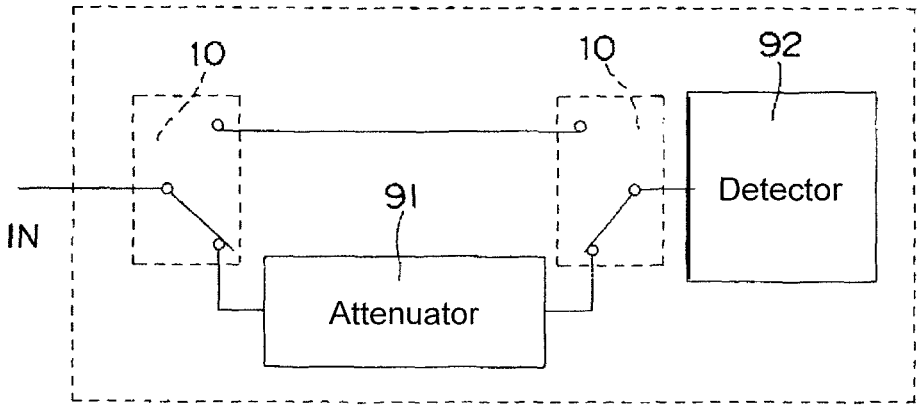
FIGS. 7A and 7B are a circuit diagram applied with a high frequency relay showing a fifth embodiment and a plan view showing a connection structure.
Figure 7:
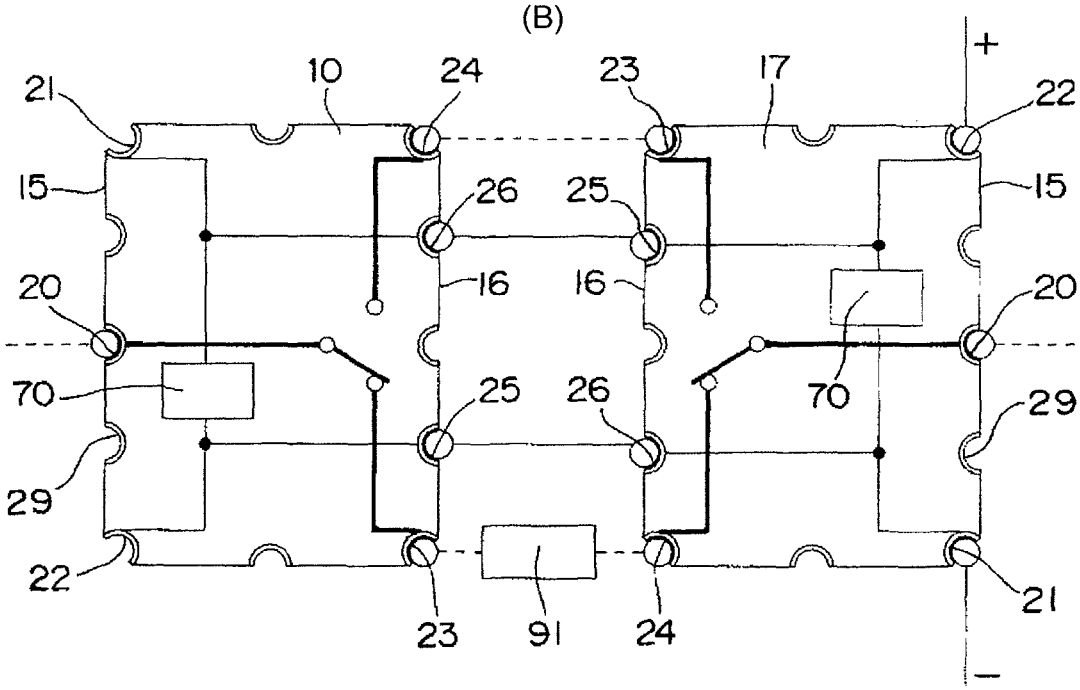

As shown in FIG. 7, a fifth embodiment is substantially the same as the fourth embodiment, and is a case where two high frequency relays 10, 17 are arranged to face each other.

In other words, the first signal terminal unit 23 of the high frequency relay 10 is connected to the second signal terminal unit 24 of the opposing high frequency relay 17 by way of the attenuator 91. The second signal terminal unit 24 of the high frequency relay 10 is connected to the first signal terminal unit 23 of the opposing high frequency relay 17. Furthermore, the third and fourth drive terminal units 25, 26 of the high frequency relay 10 are connected to the fourth and third drive terminal units 26, 25 of the opposing high frequency relay 17. The signal common terminal unit 20 of the high frequency relay 10 is connected to the signal input device (not shown), and the signal common terminal unit 20 of the high frequency relay 17 is connected to the detector 92. The first and second drive terminal units 21, 22 of the high frequency relay 17 are respectively connected to the external power supply.

According to the present embodiment, as shown in FIG. 7B, the first and second drive terminal units 21, 22 of the high frequency relay 17 are pulled out in opposite directions from both sides of the signal common terminal unit 20. Thus, the signal line and the power supply line of the printed circuit board (not shown) to mount do not cross, and a connection structure of a high frequency relay having the desired high frequency characteristics is obtained.

Figure 8:
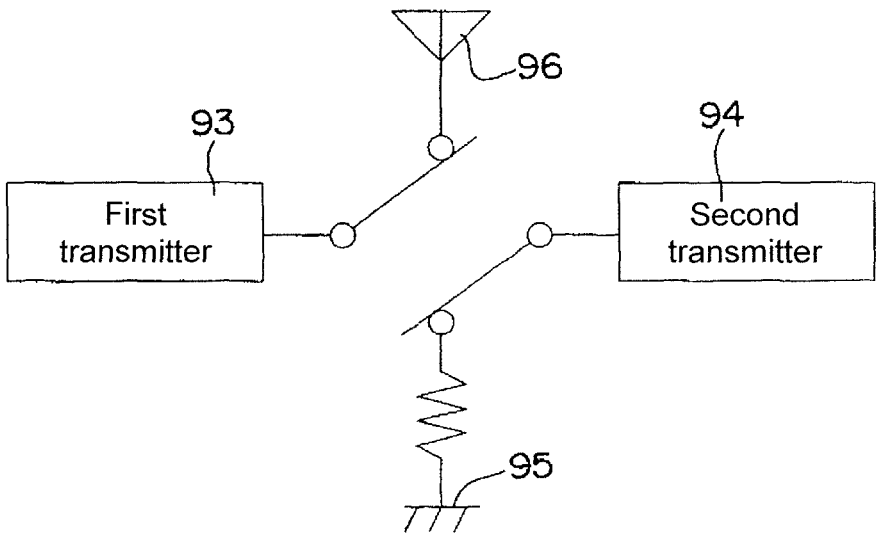
FIGS. 8A and 8B are a circuit diagram applied with a high frequency relay showing a sixth embodiment and a plan view showing a connection structure.
Figure 8:
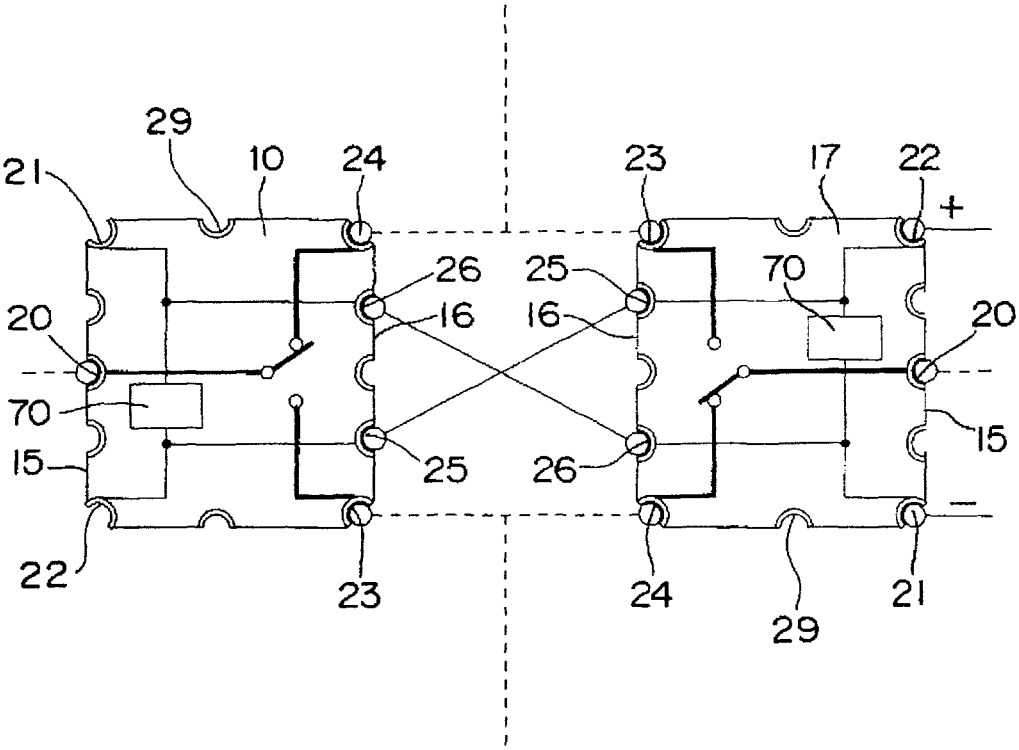

As shown in FIG. 8, a sixth embodiment is a case applied to a redundancy system switching application such as broadcast system infrastructure by connecting the pair of high frequency relays 10, 17, which are arranged to face each other, to two or first and second transmitters 93, 94.

In other words, the first signal terminal unit 23 of the high frequency relay 10 is connected to the second signal terminal unit 24 of the opposing high frequency relay 17, and also connected to the ground 95. The second signal terminal unit 24 of the high frequency relay 10 is connected to the first signal terminal unit 23 of the opposing high frequency relay 17, and also connected to the antenna 96. The signal common terminal unit 20 of the high frequency relay 10 is connected to the first transmitter 93, and the signal common terminal unit 20 of the high frequency relay 17 is connected to the second transmitter 94. The third and fourth drive terminal units 25, 26 of the high frequency relay 10 are connected to the third and fourth drive terminal units 25, 26 of the high frequency relay 17, respectively. The first and second drive terminal units 21, 22 of the high frequency relay 17 are respectively connected to the external power supply.

According to the present embodiment, the first and second drive terminal units 21, 22 of the high frequency relay 17 are pulled out in opposite directions from both sides of the signal common terminal unit 20, and thus wiring can be performed such that the power supply line and the signal line do not cross on the printed circuit board to mount, and a connection structure of a high frequency relay having excellent high frequency characteristics is obtained.

Figure 9:
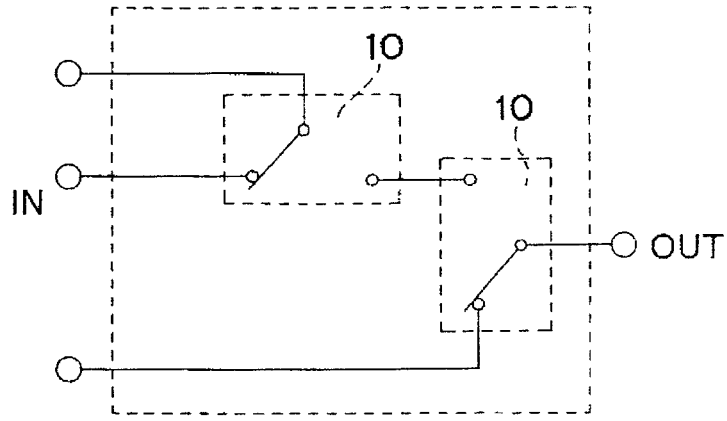
FIGS. 9A and 9B are a circuit diagram applied with a high frequency relay showing a seventh embodiment and a plan view showing a connection structure.
Figure 9:
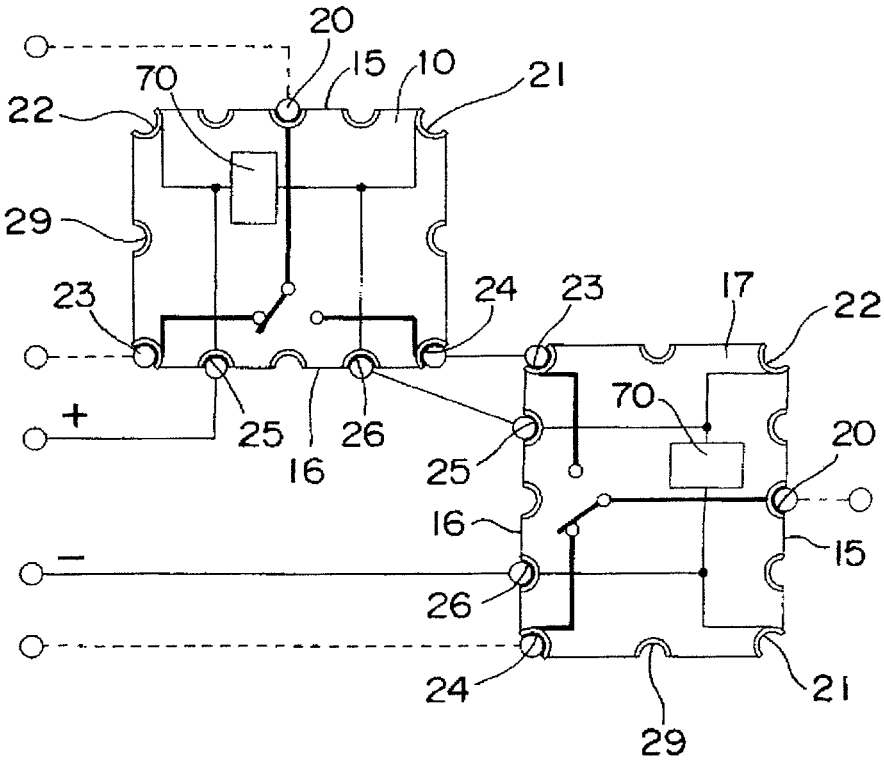

As shown in FIG. 9, a seventh embodiment is a case where two high frequency relays 10, 17 are connected, and connected to an external input device and an external output device (not shown).

In other words, the two high frequency relays 10, 17 are arranged such that the brim portions 16, 16 form right angles to each other. The second signal terminal unit 24 and the fourth drive terminal unit 26 of one high frequency relay 10 are connected to the first signal terminal unit 23 and the third drive terminal unit 25, respectively, of the other high frequency relay 17. The signal common terminal unit 20 and the first signal terminal unit 23 of the high frequency relay 10 are connected to the external input device, and the second signal terminal unit 24 of the high frequency relay 17 is connected to the external input device. The third drive terminal unit 25 of one high frequency relay 10 and the fourth drive terminal unit 26 of the other high frequency relay 17 are respectively connected to the external power supply. The signal common terminal unit 20 of the high frequency relay 17 is connected to the external output device.

According to the present embodiment, the third drive terminal unit 25 of the high frequency relay 10 and the fourth drive terminal unit 26 of the high frequency relay 17 are pulled out adjacent to each other. Thus, the signal line and the power supply line do not cross on the printed circuit board, and a connection structure of a high frequency relay having excellent high frequency characteristics can be obtained.

Figure 10:
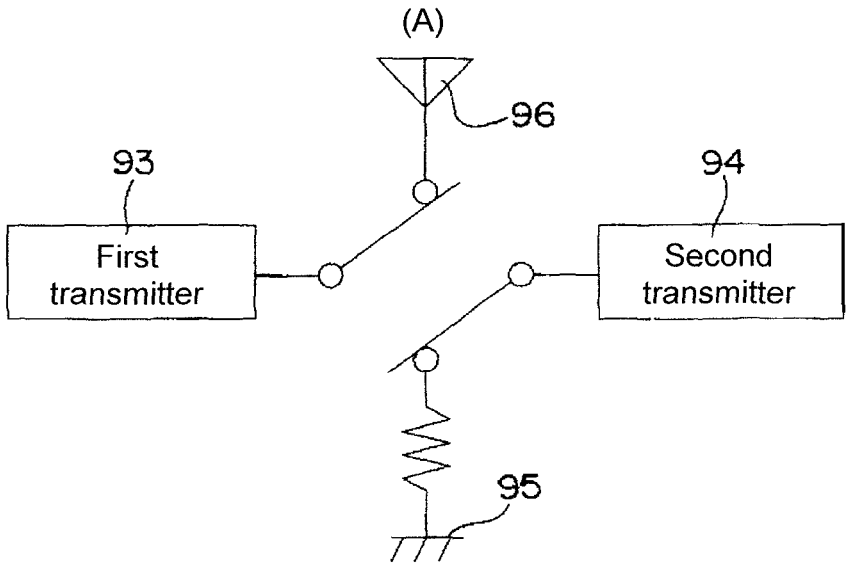
FIGS. 10A and 10B are a circuit diagram applied with a high frequency relay showing an eighth embodiment and a plan view showing a connection structure.
Figure 10:
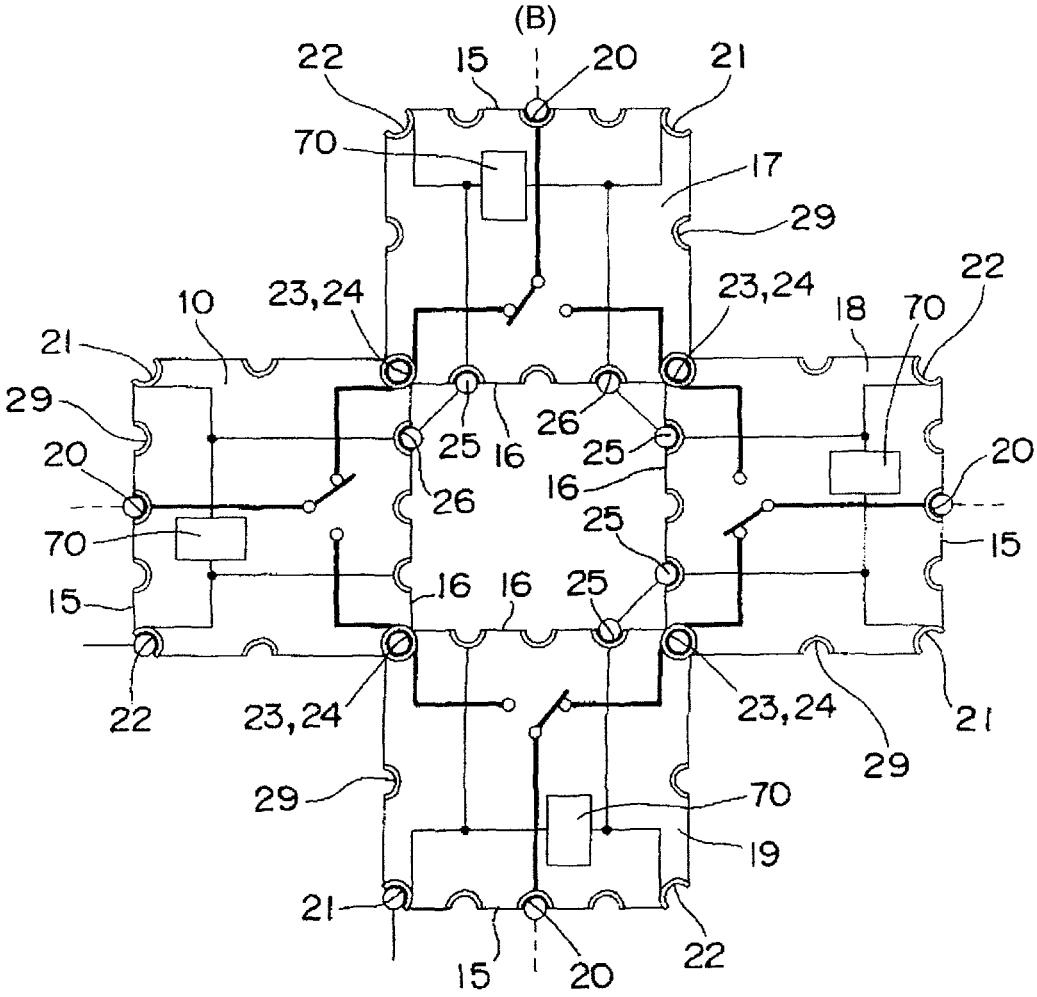

As shown in FIG. 10, an eighth embodiment is a case where fourth high frequency relays 10, 17, 18, 19 are arranged to form a square by connecting the adjacent first and second signal terminal units 25, 26 to each other.

In other words, the fourth drive terminal unit 26 of the high frequency relay 10 is connected in series to the third drive terminal unit 25 of the high frequency relay 19 by way of the third and fourth drive terminal unit 25, 26 of the high frequency relay 17 and the third and fourth drive terminal units 25, 26 of the high frequency relay 18. The second drive terminal unit 22 of the high frequency relay 10 and the first drive terminal unit 21 of the high frequency relay 19 are respectively connected to the external power supply. Furthermore, the signal common terminal unit 20 of the high frequency relay 10 is connected to the first transmitter 93, the signal common terminal unit 20 of the high frequency relay 17 to the antenna 96, the signal common terminal unit 20 of the high frequency relay 18 to the second transmitter 94, and the signal common terminal unit 20 of the high frequency relay 19 to the ground 95.

According to the present embodiment, the second drive terminal unit 22 of the high frequency relay 10 and the first drive terminal unit 21 of the high frequency relay 19 are pulled out in the same direction. Thus, the signal line and the power supply line do not cross on the printed circuit board, and a connection structure of a high frequency relay having excellent high frequency characteristics can be obtained.

Figure 11:
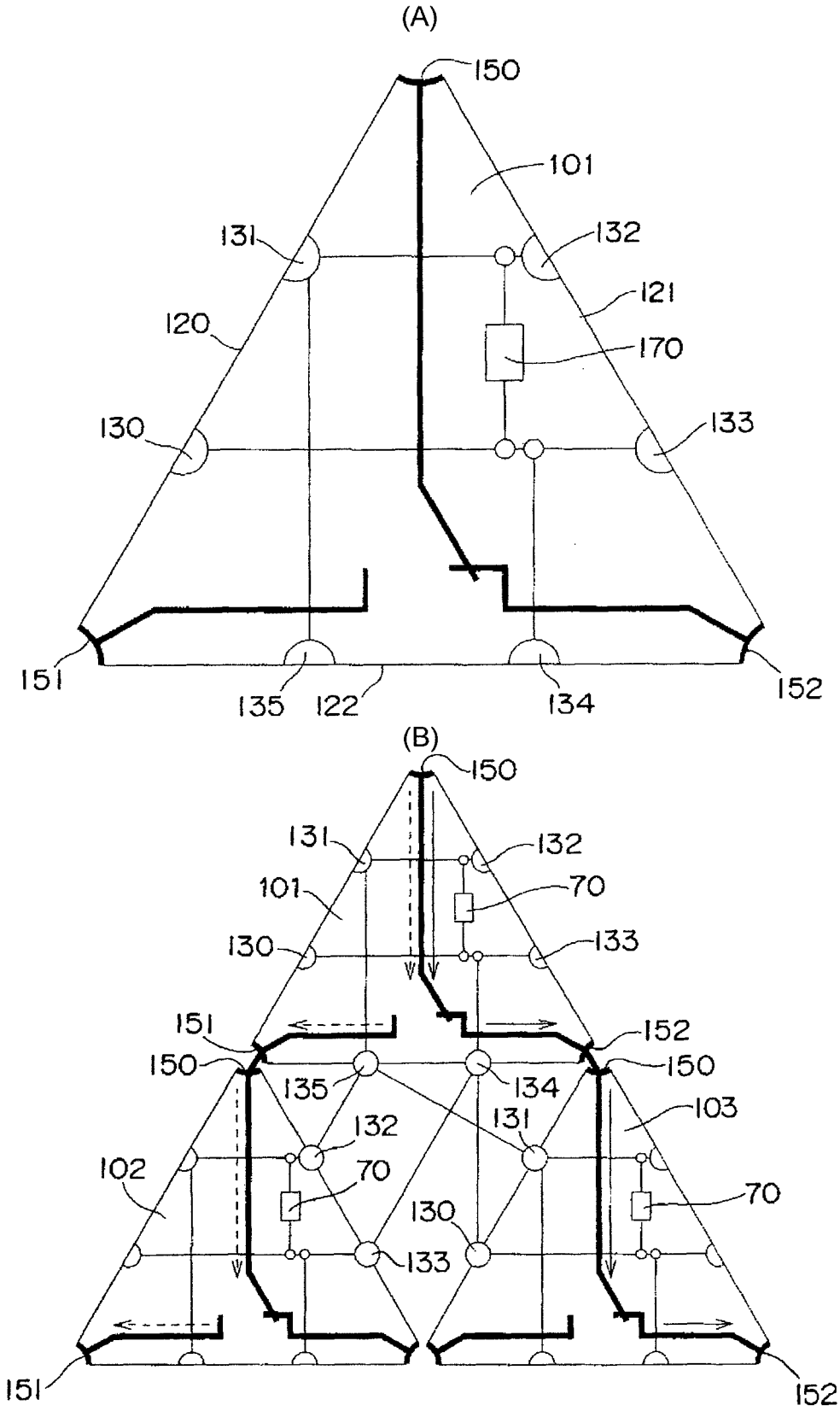
FIGS. 11A and 11B are a circuit diagram of a high frequency relay showing a ninth embodiment and a plan view showing a connection structure.

As shown in FIG. 11, a ninth embodiment is a case in which high frequency relays 101, 102, and 103 of the same structure having a plane equilateral triangular base are arranged in a pyramid shape.

The high frequency relay 101 has drive terminal units 130, 131 arranged at an outer peripheral brim portion 120, drive terminal units 132, 133 arranged at an outer peripheral brim portion 121, and drive terminal units 134, 135 arranged at an outer peripheral brim portion 122. The drive terminal units 130, 133 and 134 are mutually conductive, and connected to one end of an electromagnetic unit 170. The drive terminal units 131, 132 and 135 are mutually conductive, and connected to the other end of the electromagnetic unit 170. Furthermore, a signal common terminal unit 150, and signal terminal units 151, 152 are respectively arranged at three vertices of the high frequency relay 101.

The high frequency relays 101, 102, and 103 arranged in a pyramid shape have the drive terminal unit 135 of the high frequency relay 101 connected to the drive terminal unit 132 of the high frequency relay 102 and the drive terminal unit 131 of the high frequency relay 103, and the drive terminal unit 134 of the high frequency relay 101 connected to the drive terminal unit 133 of the high frequency relay 102 and the drive terminal unit 130 of the high frequency relay 103. The signal terminal units 151, 152 of the high frequency relay 101 are respectively connected to the signal common terminal unit 150 of the high frequency relay 102 and the signal common terminal unit 150 of the high frequency relay 103.

When voltage is not applied to the drive terminal units 130, 131 of the high frequency relay 101, the signal input from the signal common terminal unit 150 of the high frequency relay 101 (indicated with an arrowed solid line in FIG. 11B) is output from the signal terminal unit 152 via the signal common terminal unit 150 of the high frequency relay 103.

When voltage is applied to the drive terminal units 130, 131 of the high frequency relay 101 to excite the electromagnetic unit 170, and the movable contact piece is driven to switch the contact, the electromagnetic units 170, 170 of the other high frequency relays 102, 103 are simultaneously excited, the movable contact piece is driven to simultaneously switch the fixed contact, and such a state is maintained even if the application of voltage is stopped. The signal input from the signal common terminal unit 150 of the high frequency relay 101 (indicated with an arrowed dotted line in FIG. 11B) is output from the signal terminal unit 151 via the signal common terminal unit 150 of the high frequency relay 103 from the signal terminal unit 151.

Furthermore, when voltage is applied in the direction opposite to the above to the electromagnetic unit 170 from the drive terminal units 132, 133 of the high frequency relay 101, the movable contact piece of the high frequency relays 101, 102, and 103 are simultaneously inverted to return to the original state.

According to the present embodiment, the drive connection lines of the high frequency relays 101, 102, and 103 do not cross the signal connection line, and thus a circuit having excellent high frequency characteristics can be configured.

Figure 12:
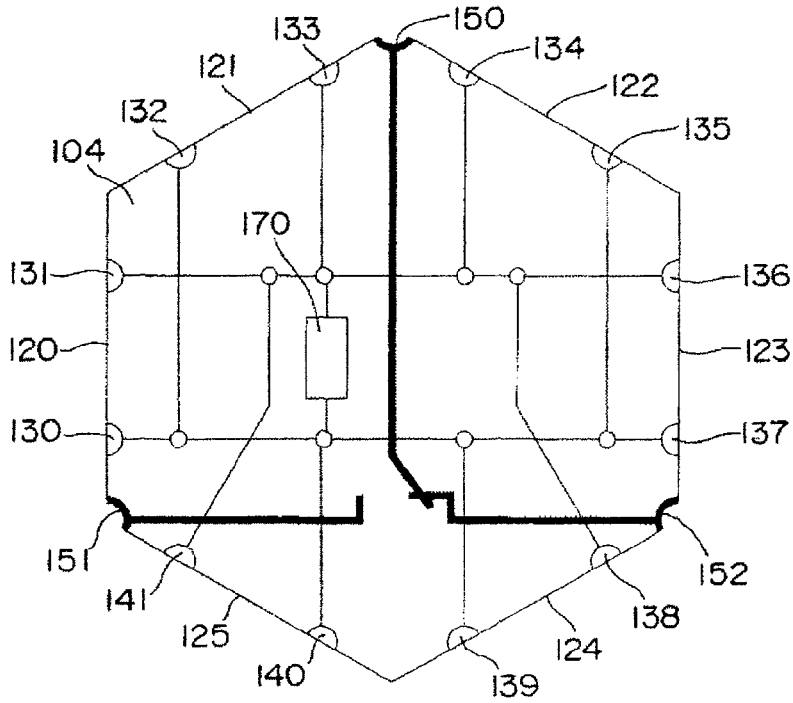
FIGS. 12A and 12B are a circuit diagram of a high frequency relay showing a tenth embodiment and a plan view showing a connection structure.
Figure 12:
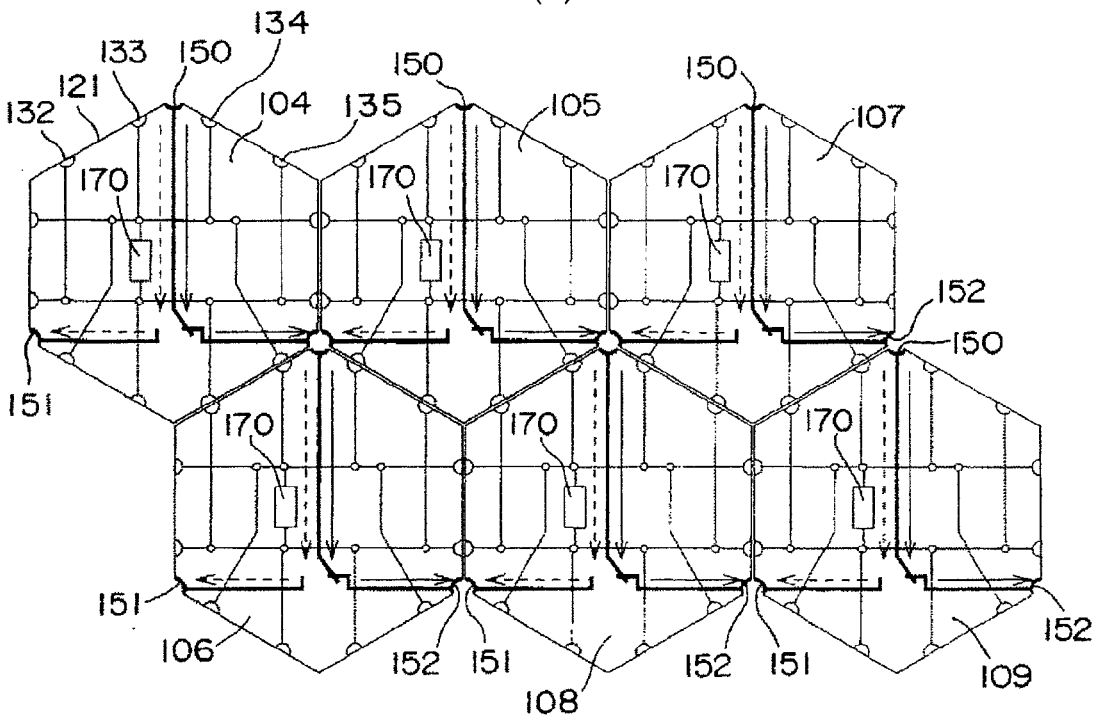

As shown in FIG. 12, a tenth embodiment is a case high frequency relays 104 to 109 of the same structure having a plane regular hexagonal base are arranged in a honeycomb shape.

The high frequency relay 104 has drive terminal units 130, 131 arranged at an outer peripheral brim portion 120, drive terminal units 132, 133 arranged at an outer peripheral brim portion 121, drive terminal units 134, 135 arranged at an outer peripheral brim portion 122, drive terminal units 136, 137 arranged at an outer peripheral brim portion 123, drive terminal units 138, 139 arranged at an outer peripheral brim portion 124, and drive terminal units 140, 141 arranged at an outer peripheral brim portion 125. The drive terminal units 130, 132, 135, 137, 139 and 140 are mutually conductive, and connected to one end of the electromagnetic unit 170. The drive terminal units 131, 133, 134, 136, 138 and 141 are mutually conductive, and connected to the other end of the electromagnetic unit 170. Furthermore, the signal common terminal unit 150, and the signal terminal units 151, 152 are evenly arranged at six corners of the high frequency relay 104.

The high frequency relays 105, 106 are joined to and electrically connected to the outer peripheral brim portions 123, 124 of high frequency relay 104, and the high frequency relays 107, 108, and 109 are sequentially joined and electrically connected to be arranged in a honeycomb shape.

When voltage is not applied to the drive terminal units 132, 133 of the high frequency relay 104, the signals input from the signal common terminal unit 150 of the high frequency relays 104, 105, 107 pass through each signal common terminal unit 150 of the high frequency relays 106, 108, 109 from each signal terminal unit 152 of the high frequency relays 104, 105, 107 and output from each signal terminal unit 152.

When voltage is applied to the drive terminal units 132, 133 of the high frequency relay 104, all the electromagnetic units 170 are simultaneously excited, the movable contact pieces are driven to simultaneously switch the contact, and such a state is maintained even if the application of voltage is stopped. Thus, the signal input from each signal common terminal unit 150 of the high frequency relays 104, 105, 107 is output from each signal terminal unit 151 of the high frequency relays 104, 105, 107. In particular, the signal input to each signal common terminal unit 150 of the high frequency relays 106, 108 is output from each signal terminal unit 151.

When voltage is applied in the direction opposite to the above to the electromagnetic unit 170 from the drive terminal units 134, 135 of the high frequency relay 104, all the electromagnetic units 170 are excited in the opposite direction, the movable contact piece is returned and the contact is switched to return to the original state.

Figure 13:
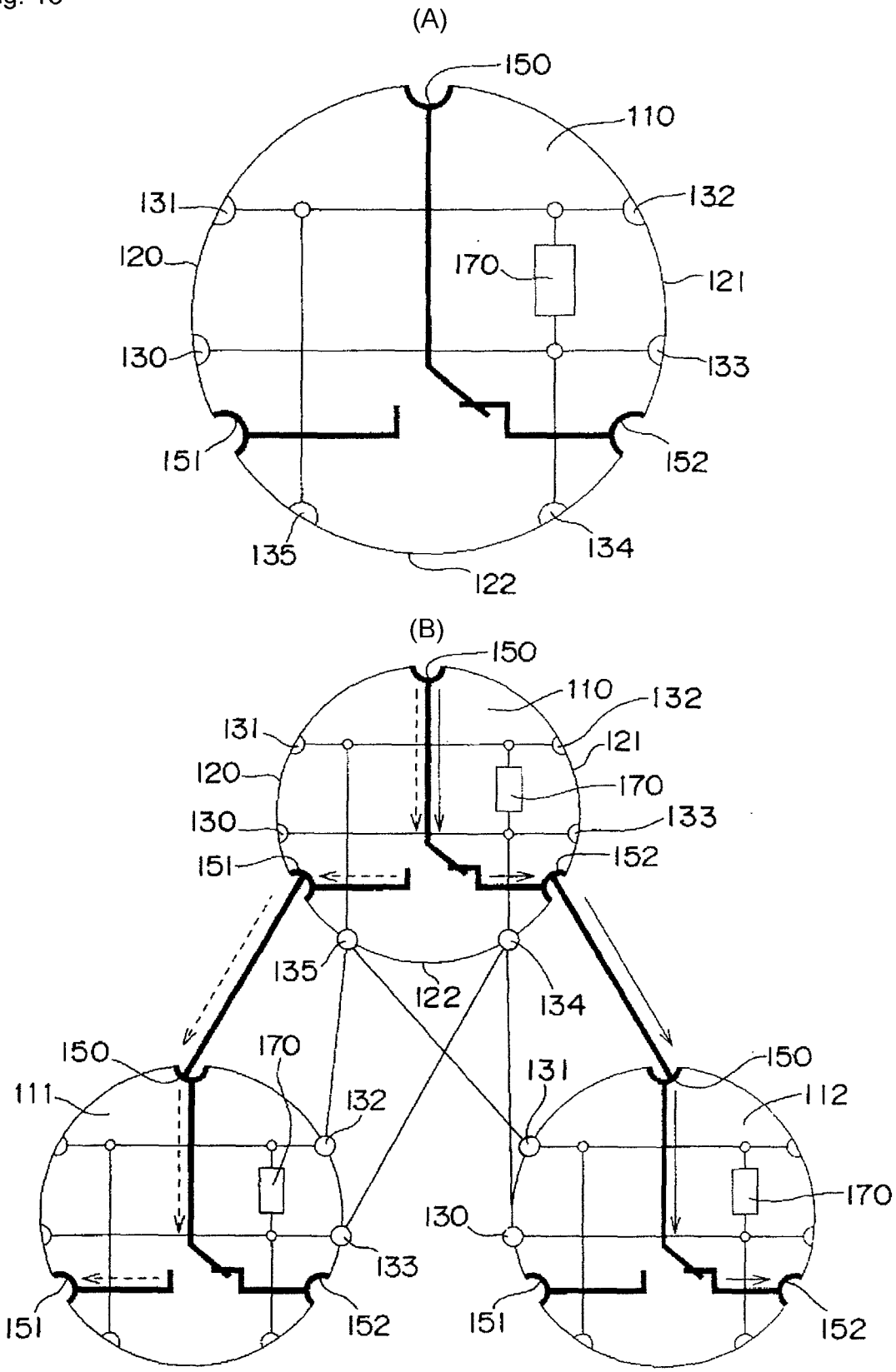
FIGS. 13A and 13B are a circuit diagram of a high frequency relay showing an eleventh embodiment and a plan view showing a connection structure.

As shown in FIG. 13, an eleventh embodiment is a case in which high frequency relays 110, 111, 112 of the same structure having a plane circular base are arranged at an equal interval.

The high frequency relay 110 has, of the outer peripheral brim portions 120, 121, 122 of the region dividing the circular base into three regions, the drive terminal units 130, 131 arranged at the outer peripheral brim portion 120, the drive terminal units 132, 133 arranged at the outer peripheral brim portion 121, and the drive terminal units 134, 135 arranged at the outer peripheral brim portion 122. The drive terminal units 130, 133, 134 are mutually conductive and are connected to one end of the electromagnetic unit 170. The drive terminal units 131, 132, 135 are mutually conductive and are connected to the other end of the electromagnetic unit 170. The signal common terminal unit 150, and the signal terminal units 152, 151 are arranged at the outer peripheral brim portion in the vicinity in the clockwise direction of the drive terminal units 131, 133, 135.

The high frequency relays 110, 111, 112 are arranged at equal interval to each other, and the signal terminal units 151, 152 of the high frequency relay 110 are respectively connected to the signal common terminal units 150, 150 of the high frequency relays 111, 112. The drive terminal unit 135 of the high frequency relay 110 is connected to the drive terminal unit 132 of the high frequency relay 111 and the drive terminal unit 130 of the high frequency relay 112. The drive terminal unit 134 of the high frequency relay 110 is connected to the drive terminal unit 133 of the high frequency relay 111 and the drive terminal unit 131 of the high frequency relay 112.

When voltage is not applied to the drive terminal units 130, 131 of the high frequency relay 110, for example, the signal input from the signal common terminal unit 150 of the high frequency relay 110 passes through the signal common terminal unit 150 of the high frequency relay 112 from the signal terminal unit 152 of the high frequency relay 110, and output from the signal terminal unit 152.

Then, when voltage is applied to the drive terminal units 130, 131 to excite the electromagnetic unit 170, all the electromagnetic units 170 are simultaneously excited, the movable contact piece is drive to simultaneously switch the contact, and such a state is maintained even if the application of voltage is stopped. Thus, the signal input from the signal terminal unit 150 of the high frequency relay 110 passes through the signal terminal unit 151 of the high frequency relay 110, and output from the signal terminal unit 151 through the signal common terminal unit 150 of the high frequency relay 111.

When voltage is applied in the direction opposite to the above to the electromagnetic unit 170 from the drive terminal units 132, 133 of the high frequency relay 110, all the electromagnetic units 170 are excited in the opposite direction, the movable contact piece is returned and the contact is switched to return to the original state.

In the embodiments described above, a case of incorporating the drive mechanism of electromagnet type has been described, but is not necessarily limited thereto, and the drive mechanism of piezoelectric element type, capacitance type, or heat generation type may be incorporated.

It should be recognized that the high frequency relay is not limited to the self-holding type, and may be a self-returning type.

The drive terminal unit of one high frequency relay may not only be connected to the drive terminal unit of the other high frequency relay such that the movable contact piece is driven in the same direction, and may be connected such that the movable contact piece is driven in different directions.

The high frequency relay of plane triangle, square, hexagon, or circular shape may be appropriately combined, as necessary.

Industrial Applicability

The high frequency relay according to the present invention is not limited to the above-described embodiments, and may be applied to the high frequency relay having other structures and the connection structure thereof.

The invention claimed is:

1. A high frequency relay comprising:

an electromagnetic unit that is formed by a coil wound to a central part of an iron core;

a base with a plane region that comprises a signal line, wherein the signal line is configured such that the signal line defines three regions on the plane region, and at least two drive terminal units connected to the coil arranged at an outer peripheral brim portion of at least two regions of the three regions.

2. The high frequency relay according to claim 1, wherein the base is a plane square.

3. The high frequency relay according to claim 2, wherein a signal common terminal unit arranged at one brim portion of opposing brim portions, on both sides of the plane square base and a pair of first and second signal terminal units arranged at a remaining other brim portion are alternately connectable;

a first drive terminal unit of a pair of first and second drive terminal units arranged on one of the brim portions divided by the signal common terminal unit of the brim portion is mutually conducted to a fourth drive terminal unit of a pair of third and fourth drive terminal units arranged between the first and second signal terminal units and connected to one end of an electromagnetic unit; and the second drive terminal unit is mutually conducted to the third drive terminal unit and connected to the other end of the electromagnetic unit.

4. A connection structure of a high frequency relay, wherein a pair of high frequency relays according to claim 3 are arranged to face brim portions arranged with first and second signal terminal units with respect to each other;

first and second terminal units of the high frequency relay are connected to second and first signal terminal units of the opposing high frequency relay; and third and fourth drive terminal units of the high frequency relay are connected to fourth and third drive terminal units of the opposing high frequency relay.

* * * * *